US008647472B2

(12) United States Patent
Cheng et al.

(10) Patent No.: US 8,647,472 B2
(45) **Date of Patent: *Feb. 11, 2014**

(54) METHOD OF INCREASING FILLER CONTENT IN PAPERMAKING

(75) Inventors: Weiguo Cheng, Naperville, IL (US); Ross T. Gray, Plainfield, IL (US)

(73) Assignee: Nalco Company, Naperville, IL (US)

( * ) Notice: Subject to any disclaimer, the term of this patent is extended or adjusted under 35 U.S.C. 154(b) by 559 days.

This patent is subject to a terminal disclaimer.

(21) Appl. No.: 12/727,299

(22) Filed: Mar. 19, 2010

(65) Prior Publication Data

US 2011/0226433 A1 Sep. 22, 2011

Related U.S. Application Data

(63) Continuation-in-part of application No. 11/854,044, filed on Sep. 12, 2007, now Pat. No. 8,172,983.

(51) Int. Cl.

| | |
|---|---|
| ***D21H 17/33*** | (2006.01) |
| ***D21H 17/45*** | (2006.01) |
| ***D21H 17/63*** | (2006.01) |
| ***D21H 17/67*** | (2006.01) |
| ***D21H 23/00*** | (2006.01) |
| ***C09C 1/02*** | (2006.01) |
| ***C09C 1/42*** | (2006.01) |
| ***C09C 3/00*** | (2006.01) |

(52) U.S. Cl.

USPC ..... 162/168.3; 162/158; 162/164.6; 162/181.1; 162/181.2; 162/181.4; 162/181.8; 162/185; 106/400; 106/416; 106/448; 106/461; 106/465; 106/487; 106/499

(58) Field of Classification Search

USPC ..... 162/158, 164.3, 164.6, 168.3, 181.1, 162/181.2, 181.4, 18.6, 185; 106/401, 416, 106/446, 448, 461, 465, 487, 499

See application file for complete search history.

(56) References Cited

U.S. PATENT DOCUMENTS

| | | | | |
|---|---|---|---|---|
| 2,037,525 | A | 4/1936 | Marantz | |
| 3,235,490 | A * | 2/1966 | Goren | 210/728 |
| 3,556,932 | A * | 1/1971 | Coscia et al. | 162/166 |
| 4,181,567 | A | 1/1980 | Riddell et al. | |
| 4,272,297 | A * | 6/1981 | Brooks et al. | 106/465 |
| 4,605,702 | A | 8/1986 | Guerro et al. | |
| 4,710,270 | A | 12/1987 | Sundén et al. | |

(Continued)

FOREIGN PATENT DOCUMENTS

GB 2016498 8/1982

OTHER PUBLICATIONS

International Search Report for PCT/ US2011/028917, 2011, 3 pages.*

(Continued)

*Primary Examiner* — Dennis Cordray
(74) *Attorney, Agent, or Firm* — Benjamin E. Carlsen

(57) ABSTRACT

The invention provides a method of producing paper with a higher proportion of mineral filler particles than is otherwise be possible without the expected loss in paper strength by preflocculating the filler particles. The method allows for the use of the greater amount of filler particles by coating at least some of the filler particles with a material that prevents the filler materials form adhering to a strength additive. The strength additive holds the paper fibers together tightly and is not wasted on the filler particles.

23 Claims, 1 Drawing Sheet

(56) References Cited

U.S. PATENT DOCUMENTS

| | | | | |
|---|---|---|---|---|
| 4,925,530 | A * | 5/1990 | Sinclair et al. | 162/164.1 |
| 4,943,349 | A * | 7/1990 | Gomez | 162/158 |
| 5,338,816 | A | 8/1994 | Ramesh et al. | |
| 6,190,663 | B1 | 2/2001 | Hawkins et al. | |
| 6,733,674 | B2 | 5/2004 | Sarkar et al. | |
| 7,211,608 | B2 | 5/2007 | Niinikoski | |
| 2005/0161181 | A1 | 7/2005 | St. John et al. | |
| 2009/0020250 | A1 * | 1/2009 | Kimura et al. | 162/164.6 |
| 2009/0065162 | A1 | 3/2009 | Cheng et al. | |
| 2009/0162642 | A1 * | 6/2009 | Ono et al. | 428/330 |
| 2009/0267258 | A1 | 10/2009 | Cheng et al. | |
| 2010/0126684 | A1 * | 5/2010 | Cheng et al. | 162/162 |

OTHER PUBLICATIONS

Smook, Gary A., Handbook for Pulp and Paper Technologists, 2nd ed, Angus Wilde Publications, 1992, p. 220.*

* cited by examiner

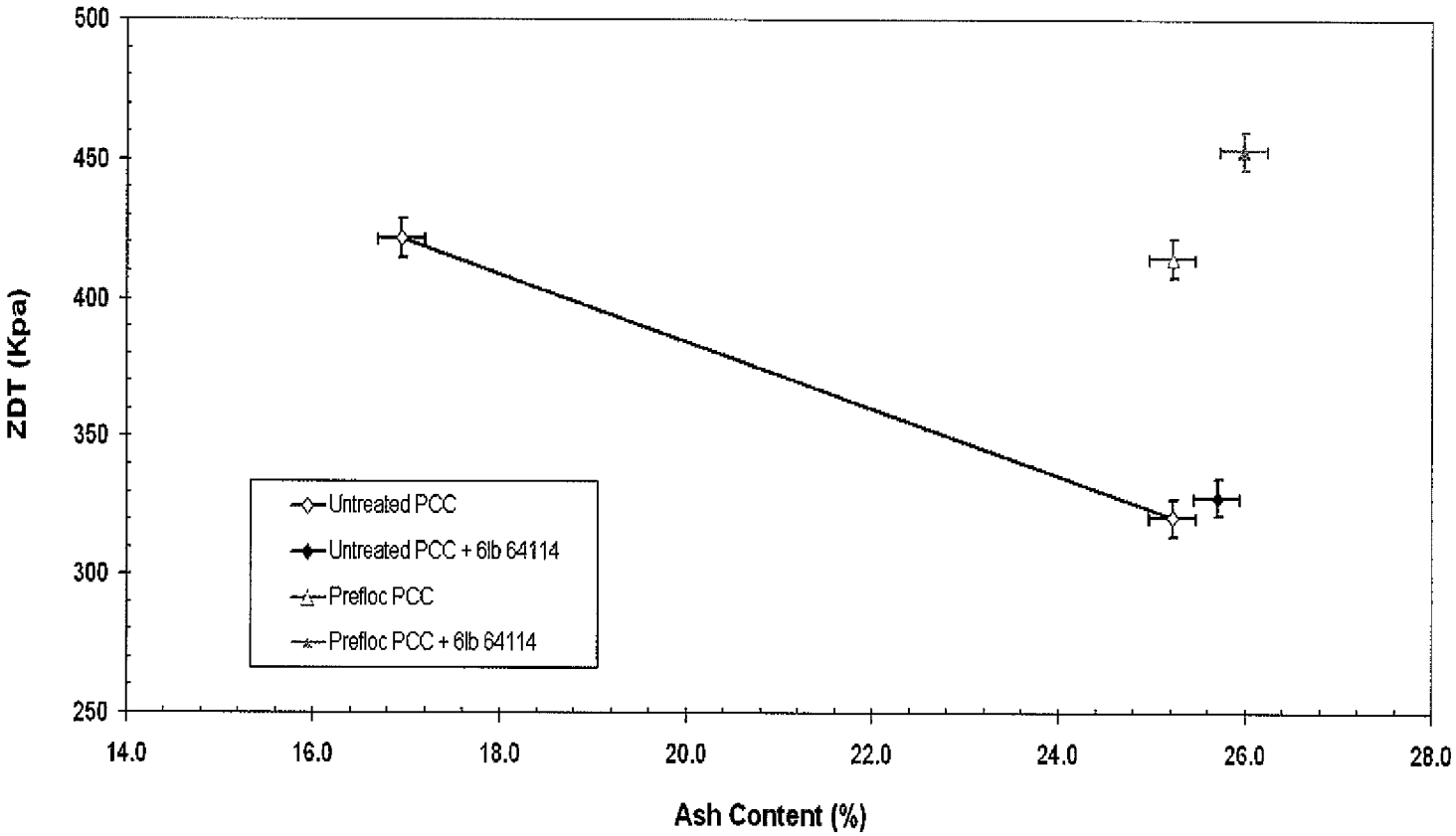
ZDT (kPa)
500
450
400
350
300
250
14.0
16.0
18.0
20.0
22.0
24.0
26.0
28.0
Ash Content (%)
Untreated PCC
Untreated PCC + 6lb 64114
Prefloc PCC
Prefloc PCC + 8lb 64114

METHOD OF INCREASING FILLER CONTENT IN PAPERMAKING

CROSS-REFERENCE TO RELATED APPLICATIONS

This application is a continuation in part of U.S. patent application Ser. No. 11/854,044 now issued as U.S. Pat. No. 8,172,983 filed on Sep. 12, 2007.

STATEMENT REGARDING FEDERALLY SPONSORED RESEARCH OR DEVELOPMENT

Not Applicable.

BACKGROUND OF THE INVENTION

This invention relates to a method of increasing the strength of a paper mat of fibers produced in a papermaking process. Paper mat comprises water and solids and is commonly 4 to 8% water. The solid portion of the paper mat includes fibers (typically cellulose based fibers) and can also include filler. Increasing the strength of the paper mat would allow one to increase the proportion of the solids that is filler content. This is desirable because it reduces raw materials costs, reduces energy needed in the papermaking process, and increases the optical properties of the paper. Prior Art discloses paper mat having a solid portion of between 10% and 40% filler. The Prior Art however also discloses that increasing the filler content coincides with a loss in strength in the resulting paper.

Fillers are mineral particles that are added to paper mat during the papermaking process to enhance the resulting paper's opacity and light reflecting properties. Some examples of fillers are described in U.S. Pat. No. 7,211,608. Fillers include inorganic and organic particles or pigments used to increase the opacity or brightness, or reduce the cost of the paper or paperboard sheet. Some examples of fillers include one or more of: kaolin clay, talc, titanium dioxide, alumina trihydrate, barium sulfate, magnesium hydroxide, pigments such as calcium carbonate, and the like. Previous attempts to increase the filler content in paper without losing paper strength are described in British Patent GB 2016498, and U.S. Pat. Nos. 4,710,270, 4,181,567, 2,037,525, 7,211,608, and 6,190,663.

Calcium carbonate filler comes in two forms, GCC (ground calcium carbonate) and PCC (precipitated calcium carbonate). GCC is naturally occurring calcium carbonate rock and PCC is synthetically produced calcium carbonate. Because it has a greater specific surface area, PCC has greater light scattering abilities and provides better optical properties to the resulting paper. For the same reason however, PCC filled paper mat produces paper which is weaker than GCC filled paper.

Paper strength is a function of the number and the strength of the bonds formed between interweaved fibers of the paper mat. Filler particles with greater surface area are more likely to become engaged to those fibers and interfere with the number and strength of those bonds. Because of its greater surface area, PCC filler interferes with those bonds more than GCC.

As a result, papermakers are forced to make an undesirable tradeoff. They must either choose to select a paper with superior strength but inferior optical properties or they must select a paper with superior optical properties but inferior strength. Thus there is a clear need for a method of papermaking that facilitates a greater amount of filler in the paper, a paper that has a high opacity, and a filled paper that has a high degree of strength.

BRIEF SUMMARY OF THE INVENTION

At least one embodiment of the invention is directed towards a method of papermaking having an increased filler content. The method comprises the steps of: adding a first flocculating agent to an aqueous dispersion in an amount sufficient to mix uniformly in the dispersion without causing significant flocculation of the filler particles, adding a second flocculating agent to the dispersion after adding the first flocculating agent in an amount sufficient to initiate flocculation of the filler particles in the presence of the first flocculating agent, the second flocculating agent being of opposite charge to the first flocculant, combining the filler particles with the paper fiber stock, treating the combination with at least one strength additive, and forming a paper mat from the combination. The paper fiber stock comprises a plurality of fibers and water, and the initiated flocculation enhances the performance of the strength additive in the paper mat.

At least one embodiment of the invention is directed towards this method in which the strength of the paper made by the papermaking process is increased by an amount greater than the sum of: the strength enhancement provided by the preflocculation process using the first and second flocculating agents and the strength enhancement provided by the strength additive by itself.

The filler may be selected from the group consisting of calcium carbonate, kaolin clay, talc, titanium dioxide, alumina trihydrate, barium sulfate, and magnesium hydroxide. The paper fiber may be cellulose fiber. The method may further comprise the step of shearing the dispersion to obtain a predetermined floc size. The filler flocs may have a median particle size of 10-100 μm. The first and second flocculating agents may have an RSV of at least 2 dL/g. The first flocculating agent may be anionic. The strength additive may be glyoxylated Acrylamide/DADMAC copolymer. The ratio of strength additive relative to the solid portion of the paper mat may be 0.3 to 5 kg of strength additive per ton of paper mat. The first flocculating agent may be a copolymer of acrylamide and sodium acrylate. The strength additive may be a cationic starch. The strength additive and the second flocculating agent may carry the same charge.

The second flocculating agent may be selected from the list consisting of copolymers of acrylamide with DMAEM, DMAEA, DEAEA, DEAEM. The second flocculating agent may be in quaternary ammonium salt form made with a salt selected from the list consisting of dimethyl sulfate, methyl chloride, benzyl chloride, and any combination thereof. The filler may be anionically dispersed and a low molecular weight, cationic coagulant is added to the dispersion to at least partially neutralize its anionic charge prior to the addition of the first flocculating agent. The second flocculating agent may have a charge, which is opposite to the charge of the first flocculating agent. The filler flocs may have a median particle size of 10-100 μm. The filler may be selected from the group consisting of calcium carbonate, kaolin clay, talc, titanium dioxide, alumina trihydrate, barium sulfate and magnesium hydroxide. The low molecular weight composition may be a cationic coagulant, the first flocculating agent may be an anionic flocculent, the second flocculating agent may be a cationic flocculent, and both flocculants may have a molecular weight of at least 1,000,000

BRIEF DESCRIPTION OF THE DRAWINGS

A detailed description of the invention is hereafter described with specific reference being made to the drawings in which:

FIG. 1 is a graph showing the improved strength of paper made according to the invention.

DETAILED DESCRIPTION OF THE INVENTION

For purposes of this application the definition of these terms is as follows:

"Coagulant" means a composition of matter having a higher charge density and lower molecular weight than a flocculant, which when added to a liquid containing finely divided suspended particles, destabilizes and aggregates the solids through the mechanism of ionic charge neutralization.

"DMAEM" means dimethylaminoethylmethacrylate as described and defined in U.S. Pat. No. 5,338,816.

"DMAEA" means dimethylaminoethylacrylate as described and defined in U.S. Pat. No. 5,338,816.

"DEAEA" means diethylaminoethyl acrylate as described and defined in U.S. Pat. No. 6,733,674.

"DEAEM" means diethylaminoethyl methacrylate as described and defined in U.S. Pat. No. 6,733,674.

"Flocculant" means a composition of matter having a low charge density and a high molecular weight (in excess of 1,000,000) which when added to a liquid containing finely divided suspended particles, destabilizes and aggregates the solids through the mechanism of interparticle bridging.

"Flocculating Agent" means composition of matter that when added to a liquid, destabilizes and aggregates colloidal and finely divided suspended particles in liquid into flocs.

"GCC" means ground calcium carbonate, which is manufactured by grinding naturally occurring calcium carbonate rock "PCC" means precipitated calcium carbonate which is synthetically produced.

"Preflocculation" means the modification of filler particles into agglomerates through treatment with a particular flocculating agent selected on the basis of the size distribution and stability of the floc that the flocculating agent will form.

In the event that the above definitions or a definition stated elsewhere in this application is inconsistent with a meaning (explicit or implicit) which is commonly used, in a dictionary, or stated in a source incorporated by reference into this application, the application and the claim terms in particular are understood to be construed according to the definition in this application, and not according to the common definition, dictionary definition, or the definition that was incorporated by reference.

At least one embodiment of the invention is a method of making paper, which is strong, has a high filler content, and has superior optical properties. In at least one embodiment of the invention the method of papermaking comprises the steps of: providing filler material, pre-treating at least some of the filler material by preflocculation leading to a decrease in the adsorption of a strength additive on the filler material, and adding both the preflocculated filler blend and the strength additive to the paper mat.

Preflocculation is a process in which, material is treated by two flocculating agents in a manner that optimizes the size distribution and stability of the flocs under a particular shear force prior to its addition to the paper stock. The particular chemical environment and high fluid shear rates present in modern high-speed papermaking require filler flocs to be stable and shear resistant. The floc size distribution provided by a preflocculation treatment should minimize the reduction of sheet strength with increased filler content, minimize the loss of optical efficiency from the filler particles, and minimize negative impacts on sheet uniformity and printability. Furthermore, the entire system must be economically feasible. Examples of preflocculation methods applicable to this invention are described in US Published Application 2009/0065162 A1 and U.S. application Ser. No. 12/431,356.

It has been known for some time that adding strength additives to paper mat increases the strength of the resulting paper. Some examples of strength additives are described in U.S. Pat. No. 4,605,702. Some examples of strength additives are cationic starches, which adhere to the cellulose fibers and tightly bind them together.

Unfortunately it is not practical to add large amounts of strength additives to compensate for the weakness that results from using large amounts of filler in paper mat. One reason is because strength additives are expensive and using large amounts of additives would result in production costs that are commercially non-viable. In addition, adding too much strength additive negatively affects the process of papermaking and inhibits the operability of various forms of papermaking equipment. As an example, in the context of cationic starch strength additives, the cationic starch retards the drainage and dewatering process, which drastically slows down the papermaking process.

Adding filler to the paper mat reduces the effectiveness of the strength additive. Because filler has a much higher specific surface area than fiber, most of the strength additives added into the papermaking slurry go to filler surfaces, and therefore there is less strength additive available to bind the cellulose fibers together. This effect is more acute with PCC compared to GCC because PCC has a much higher surface area and is able to adsorb more strength additive. One method of addressing this situation is by pre-treating the filler material with a coagulant as described in U.S. application Ser. No. 12/323,976. Another method involves using preflocculation instead of a coagulant.

In at least one embodiment the filler content in the paper is increased by the following method: An aqueous dispersion of filler materials is formed and the filler materials are preflocculated before being added to a paper fiber stock. A first flocculating agent is added to the dispersion in an amount sufficient to mix uniformly in the dispersion without causing significant flocculation of the filler particles. A second flocculating agent is then added following the first flocculating agent, in an amount sufficient to initiate flocculation of the filler material in the presence of the first flocculating agent, the second flocculating agent being of opposite charge to the first flocculating agent. A paper mat is formed by combining the preflocculated filler material with the fiber stock and treating this combination with the strength additive. The preflocculation of the filler material enhances the performance of the strength additive. The fiber stock comprises fibers, fillers, and water.

In at least one embodiment, the fibers are predominantly cellulose based. In at least one embodiment the flocculated dispersion is sheared to obtain a particularly desired particle size.

While pre-treating filler particles is known in the art, prior art methods of pre-treating filler particles are not directed towards affecting the adhesion of the strength additive to the filler particles with two flocculants. In fact, many prior art pre-treatments increase the adhesion of the strength additive to the filler particles. For example, U.S. Pat. No. 7,211,608 describes a method of pre-treating filler particles with hydrophobic polymers. This pre-treatment however does nothing to the adhesion between the strength additive and the filler particles and merely repels water to counterbalance an excess of water absorbed by the strength additive. In contrast, the invention decreases the interactions between the strength additive and the filler particles and results in an unexpectedly huge increase in paper strength. This can best be appreciated by reference to FIG. 1.

FIG. 1 illustrates that a paper produced from a paper mat that includes PCC filler tends to become weaker as more PCC filler is added. When a large amount of PCC is added (over 25%), the addition of a strength additive adds little strength to the paper. Paper made from preflocculated PCC filler combined with a strength additive however increases the strength of the paper to a degree that it is stronger than paper having 10% less PCC that is not preflocculated. Even more surprising was the fact that paper containing preflocculated PCC without a strength additive was almost as strong as the paper with the strength additive.

As a result, at least two conclusions can be reached, 1) the strength agent is more effective in increasing sheet strength with preflocculated filler than with untreated filler and 2) there is a synergistic effect from the combination of strength agent and filler preflocculation which makes it superior to the additive effects of the sum of the strength agent alone plus the filler preflocculation alone. As a result, preflocculation of the PCC filler material leads to the production of paper that is unexpectedly strong.

At least some of the fillers encompassed by this invention are well known and commercially available. They include any inorganic or organic particle or pigment used to increase the opacity or brightness, reduce the porosity, or reduce the cost of the paper or paperboard sheet. The most common fillers are calcium carbonate and clay. However, talc, titanium dioxide, alumina trihydrate, barium sulfate, and magnesium hydroxide are also suitable fillers. Calcium carbonate includes ground calcium carbonate (GCC) in a dry or dispersed slurry form, chalk, precipitated calcium carbonate (PCC) of any morphology, and precipitated calcium carbonate in a dispersed slurry form. The dispersed slurry forms of GCC or PCC are typically produced using polyacrylic acid polymer dispersants or sodium polyphosphate dispersants. Each of these dispersants imparts a significant anionic charge to the calcium carbonate particles. Kaolin clay slurries also are dispersed using polyacrylic acid polymers or sodium polyphosphate.

In at least one embodiment, the strength additive carries the same charge as the second flocculating agent. Strength additives encompassed by the invention include any one of the compositions of matter described in U.S. Pat. No. 4,605,702 and US Patent Application 2005/0161181 A1 and in particular the various glyoxylated Acrylamide/DADMAC copolymer compositions described therein. An example of a glyoxylated Acrylamide/DADMAC copolymer composition is product# Nalco 64170 (made by Nalco Company, Naperville, Ill.).

In at least one embodiment, the fillers used are PCC, GCC, and/or kaolin clay. In at least one embodiment, the fillers used are FCC, GCC, and/or kaolin clay with polyacrylic acid polymer dispersants or their blends. The ratio of strength additive relative to solid paper mat can be 3 kg of additive per ton of paper mat.

In at least one embodiment, the effectiveness of the synthetic strength additive is independent of or despite the presence of some, low amounts, or no amount of starch in the paper mat. In prior art disclosures, it is known that adding between 10 to 20 lbs of starch per ton of paper mat increases the strength of the resulting paper. The addition of materials in such large amounts however is cumbersome and less than ideal. The use of synthetic strength additives in contrast allows similar strength performance to be achieved while requiring the addition of far less strength additive material to the paper mat. In at least one embodiment the synthetic strength additive is cationic or anionic or contains both cationic and anionic functional groups.

Unfortunately synthetic strength additives are known to be far more expensive than starch. In some processes the cost of using bulky large amounts of starch may be less expensive than smaller and more easily manageable amounts of synthetic strength additives. The combination of the strength adding effects of synthetic strength additives in low dosages combined with the preflocculation allows unexpected degrees of strength to be observed than would otherwise be expected with such low dosages of strength additives and in the absence of large amounts or any amount of starch.

EXAMPLES

The foregoing may be better understood by reference to the following example, which is presented for purposes of illustration and is not intended to limit the scope of the invention.

A furnish was produced containing 25% pine softwood and 75% eucalyptus hardwood. Both the softwood and hardwood were reslushed from dry lap. The filler used was Albacar HO PCC obtained from Specialty Minerals Inc. The filler material preflocculation was performed with the dual flocculant approach described in example 14 of U.S. application Ser. No. 12/431,356. During the handsheet preparation, 6 lb/ton strength additive (Nalco 64114, a glyoxalated Acrylamide/DADMAC copolymer available from Nalco Company, Naperville, Ill., USA) was added. The results are displayed in FIG. 1.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of papermaking having an increased filler content, the method comprising the steps of:

adding a first flocculating agent to an aqueous dispersion of filler particles in an amount sufficient to mix uniformly in the dispersion without causing significant flocculation of the filler particles, adding a second flocculating agent to the dispersion after adding the first flocculating agent in an amount sufficient to initiate flocculation of the filler particles in the presence of the first flocculating agent, the second flocculating agent being of opposite charge to the first flocculant, wherein no paper stock is present during the flocculation, combining the filler particles with a paper fiber stock, treating the combination with at least one strength additive selected from the group consisting of synthetic strength additives, and forming a paper mat from the combination, the paper fiber stock comprises a plurality of fibers and water, and the initiated flocculation enhances the performance of the strength additive in the paper mat, wherein the strength additive is not starch, wherein the first flocculating agent is a copolymer of acrylamide and sodium acrylate and wherein the first and second flocculating agents have an RSV of at least 2 dL/g.

2. The method of claim 1 in which the strength of the paper made by the papermaking process is increased by an amount greater than the sum of: the strength enhancement provided by the preflocculation process using the first and second flocculating agents and the strength enhancement provided by the strength additive by itself.

3. The method of claim 1 wherein the filler is selected from the group consisting of calcium carbonate, kaolin clay, talc, titanium dioxide, alumina trihydrate, barium sulfate, and magnesium hydroxide.

4. The method of claim 1 in which paper fiber is cellulose fiber.

5. The method of claim 1 further comprising the step of shearing the dispersion after flocculation has been initiated to obtain a predetermined floc size of between 10 and 100 microns.

6. The method of claim 1 wherein the first flocculating agent is anionic.

7. The method of claim 1 in which the strength additive is glyoxylated Acrylamide/DADMAC copolymer.

8. The method of claim 1 in which the ratio of strength additive relative to the solid portion of the paper mat is 0.3 to 5 kg of strength additive per ton of paper mat.

9. The method of claim 1 wherein the filler is anionically dispersed and a low molecular weight, cationic coagulant is added to the dispersion to at least partially neutralize its anionic charge prior to the addition of the first flocculating agent.

10. The method of claim 1 in which the strength additive and the second flocculating agent carry the same charge.

11. The method of claim 1 wherein the second flocculating agent is selected from the list consisting of copolymers of acrylamide with DMAEM, DMAEA, DEAEA, DEAEM.

12. The method of claim 11 in which the second flocculating agent is in quaternary ammonium salt form made with a salt selected from the list consisting of dimethyl sulfate, methyl chloride, benzyl chloride, and any combination thereof.

13. The method of claim 9 wherein the low molecular weight composition is a cationic coagulant, the first flocculating agent is an anionic flocculant, the second flocculating agent is a cationic flocculent, and both flocculants have a molecular weight of at least 1,000,000.

14. The method of claim 1 wherein the ratio of the first flocculating agent to the filler is between 0.2 and 2.0 kg flocculating agent per ton filler and the ratio of the second flocculating agent to the filler is between 0.2 and 2.0 kg flocculating agent per ton filler.

15. A method of papermaking having an increased filler content, the method comprising the steps of:

adding a first flocculating agent to an aqueous dispersion of filler particles in an amount sufficient to mix uniformly in the dispersion without causing significant flocculation of the filler particles, adding a second flocculating agent to the dispersion after adding the first flocculating agent in an amount sufficient to initiate flocculation of the filler particles in the presence of the first flocculating agent, the second flocculating agent being of opposite charge to the first flocculant, combining the filler particles with the paper fiber stock, treating the combination with at least one strength additive selected from the group consisting of synthetic strength additives, and forming a paper mat from the combination, the paper fiber stock comprises a plurality of fibers and water, and the initiated flocculation enhances the performance of the strength additive in the paper mat, wherein the strength additive is not starch and wherein the filler is anionically dispersed and a low molecular weight, cationic coagulant is added to the dispersion to at least partially neutralize its anionic charge prior to the addition of the first flocculating agent.

16. The method of claim 15 in which the strength of the paper made by the papermaking process is increased by an amount greater than the sum of: the strength enhancement provided by the preflocculation process using the first and second flocculating agents and the strength enhancement provided by the strength additive by itself.

17. The method of claim 15 wherein the filler is selected from the group consisting of calcium carbonate, kaolin clay, talc, titanium dioxide, alumina trihydrate, barium sulfate, and magnesium hydroxide.

18. The method of claim 15 in which paper fiber is cellulose fiber.

19. The method of claim 15 further comprising the step of shearing the dispersion after flocculation has been initiated to obtain a predetermined floc size of between 10 and 100 microns.

20. The method of claim 15 in which the strength additive and the second flocculating agent carry the same charge.

21. The method of claim 15 wherein the second flocculating agent is selected from the list consisting of copolymers of acrylamide with DMAEM, DMAEA, DEAEA, DEAEM.

22. The method of claim 21 in which the second flocculating agent is in quaternary ammonium salt form made with a salt selected from the list consisting of dimethyl sulfate, methyl chloride, benzyl chloride, and any combination thereof.

23. The method of claim 15 wherein the ratio of the first flocculating agent to the filler is between 0.2 and 2.0 kg flocculating agent per ton filler and the ratio of the second flocculating agent to the filler is between 0.2 and 2.0 kg flocculating agent per ton filler.

* * * * *